US010139755B2

(12) United States Patent
Sakurai et al.

(10) Patent No.: US 10,139,755 B2
(45) Date of Patent: Nov. 27, 2018

(54) DEVELOPING DEVICE WITH SIDE BY SIDE DEVELOPING SECTIONS, AND IMAGE FORMING APPARATUS WITH SAME

(71) Applicant: Konica Minolta, Inc., Chiyoda-ku, Tokyo (JP)

(72) Inventors: Shota Sakurai, Tokyo (JP); Shunichi Takaya, Tokyo (JP); Kei Okamura, Kanagawa (JP); Hideaki Tanaka, Tokyo (JP); Kazuteru Ishizuka, Saitama (JP); Kei Yuasa, Tokyo (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 15/648,846

(22) Filed: Jul. 13, 2017

(65) Prior Publication Data

US 2018/0059578 A1 Mar. 1, 2018

(30) Foreign Application Priority Data

Aug. 30, 2016 (JP) ..... 2016-168016

(51) Int. Cl.
*G03G 15/08* (2006.01)

(52) U.S. Cl.
CPC ..... *G03G 15/0889* (2013.01); *G03G 15/0893* (2013.01)

(58) Field of Classification Search
CPC ..... G03G 15/0889
USPC ..... 399/254
See application file for complete search history.

(56) References Cited

U.S. PATENT DOCUMENTS

| | | | | |
|---|---|---|---|---|
| 7,729,641 | B2 * | 6/2010 | Suzuki | G03G 15/0808 399/119 |
| 2007/0154242 | A1 * | 7/2007 | Matsumoto | G03G 15/0848 399/254 |
| 2012/0163874 | A1 * | 6/2012 | Hattori | G03G 15/0896 399/254 |

FOREIGN PATENT DOCUMENTS

| | | | |
|---|---|---|---|
| JP | 2000019821 | A * | 1/2000 |
| JP | 2002-006631 | A | 1/2002 |

* cited by examiner

*Primary Examiner* — Quana M Grainger
(74) *Attorney, Agent, or Firm* — Squire Patton Boggs (US) LLP

(57) ABSTRACT

A developing device includes: a plurality of development sections arranged in an axis direction of a developer bearing member; a communication section disposed at a boundary of adjacent two development sections of the development sections, and configured to communicate between the two development sections; and a control section configured to perform an operation of moving the developer between the two development sections through the communication section to equalize degradation states of the developer in the two development sections.

16 Claims, 7 Drawing Sheets

DEVELOPING DEVICE WITH SIDE BY SIDE DEVELOPING SECTIONS, AND IMAGE FORMING APPARATUS WITH SAME

CROSS REFERENCE TO RELATED APPLICATIONS

This application is entitled to and claims the benefit of Japanese Patent Application No. 2016-168016, filed on Aug. 30, 2016, the disclosure of which including the specification, drawings and abstract is incorporated herein by reference in its entirety.

BACKGROUND OF THE INVENTION

1. Field of the Invention

The present invention relates to a developing device and an image forming apparatus.

2. Description of Related Art

In general, an electrophotographic image forming apparatus (such as a printer, a copy machine, and a fax machine) is configured to irradiate (expose) a charged photoconductor drum (image bearing member) with (to) laser light based on image data to form an electrostatic latent image on the surface of the photoconductor. The electrostatic latent image is then visualized by supplying toner from a developing device to the photoconductor drum on which the electrostatic latent image is formed, whereby a toner image is formed. Further, the toner image is directly or indirectly transferred to a sheet, and then heat and pressure are applied to the sheet at a fixing nip to form a toner image on the sheet.

A developing device including an agitation member for agitating the developer in a developing device is known (see, for example, Japanese Patent Application Laid-Open No. 2002-6631). FIG. 1A is a sectional view schematically illustrating a conventional developing device. FIG. 1B illustrates a toner density in the axis direction in a conventional developing device. FIG. 1C illustrates a charge amount of toner in the axis direction in a conventional developing device.

As illustrated in FIG. 1A, developing device 412 includes developing sleeve 412A and development section 412B. Development section 412B includes second agitation member 412D and first agitation member 412C for agitating developer in development section 412B.

First agitation member 412C and second agitation member 412D are disposed in respective regions partitioned with partition section 412E, and are configured to rotate to convey the developer in the axis direction of developing sleeve 412A. As a result, the developer is moved in development section 412B in arrow direction X, and agitated in development section 412B.

When the developer moves in the axis direction in development section 412B in the above-mentioned manner, the toner density varies in the axis direction in the case where the toner in development section 412B is consumed and new toner is supplied thereto. For example, in the case where new toner is supplied at a position corresponding to first agitation member 412C, new toner is mixed thereto from the upstream side in the moving direction of the developer at a position corresponding to second agitation member 412D, and the toner density decreases toward the downstream side of the moving direction of the developer as illustrated in FIG. 1B. In contrast, the charge amount of toner increases toward the downstream side of the moving direction as illustrated in FIG. 1C since the smaller the toner density, the larger the amount of the toner which is mixed with the carrier and charged.

Therefore, for example, in the case where the size of the developing device is increased to process sheets which are long in the axis direction such as B1 sheet, the variation in density and charge amount of toner in the axis direction is undesirably increased in accordance with the increased size.

To solve such problems, it is conceivable to adopt a configuration in which a plurality of development sections 412B are arranged in the axis direction of developing sleeve 412A. For example, in the case where the size of developing device 412 is doubled in comparison with a conventional configuration, two conventional development sections 412B are disposed. With this configuration, even when the size of developing device 412 is increased, the movement mount of the toner in the axis direction is equal to that of the configuration of the conventional size, and therefore the variation in density and charge amount of toner in the axis direction can be suppressed to a value approximately equal to that of the configuration of the conventional size.

SUMMARY OF THE INVENTION

In some situation, sheets which are long in the axis direction are cut by a post-processing machine after the image formation. In this case, for example, an image formation process can possibly be performed such that an image of a large coverage is formed in a half region in the axis direction and an image of a small coverage is formed in the other half region in the axis direction.

In this case, a large amount of toner is consumed in development section 412B on one side in the axis direction while the toner is not largely consumed in development section 412B on the other side in the axis direction. Consequently the use history of the carrier is accumulated and the degradation of the carrier is facilitated in development section 412B on one side in comparison with development section 412B on the other side. As a result, a difference in degradation state of the carrier, that is, degradation state of the developer is easily caused between two development sections 412B.

When the carrier is degraded, the charging performance of the toner is reduced, and toner scattering is disadvantageously caused. Moreover, when the degradation state of the developer is different between development section 412B on one side and development section 412B of the other side, the charging performance of the toner is different between two development sections 412B, and the unevenness in image density in an image formed on sheet generated is disadvantageously caused.

An object of the present invention is to provide a developing device and an image forming apparatus which can reduce image defects caused by a difference in degradation state of the developer between a plurality of development sections of the developing device or the image forming apparatus.

To achieve the abovementioned object a developing device reflecting one aspect of the present invention includes: a developer bearing member configured to bear a developer; a plurality of development sections configured to house the developer to be borne on the developer bearing member, the development sections being arranged in an axis direction of the developer bearing member; a communication section disposed at a boundary of adjacent two development sections of the development sections, and configured to communicate between the two development sections; and a control section configured to perform an operation of moving the developer between the two development sections through the communication section to equalize degradation states of the developer in the two development sections.

Desirably, in the developing device, each of the development sections includes a rotatable agitation member configured to agitate the developer housed in the development section; and when moving the developer in one of the two development sections to the other of the two development sections, the control section sets a rotational frequency of the agitation member of the one of the two development sections to a value greater than a rotational frequency of the agitation member of the other of the two development sections.

Desirably, in the developing device, the control section controls the rotational frequency of the agitation member in accordance with a difference in coverage of a toner image corresponding to the two development sections.

Desirably, the developing device further includes a degradation state detection section configured to detect degradation states of developer in the two development sections. The control section controls the rotational frequency of the agitation member in accordance with a difference in degradation state of the developer between the two development sections.

Desirably, in the developing device, a plurality of the degradation state detection sections are provided in the respective development sections.

Desirably, in the developing device, the agitation member includes: a first agitation member configured to move the developer to a side opposite to the communication section in the axis direction, and a second agitation member configured to move the developer to the communication section side in the axis direction; and the communication section is located at a position corresponding to the second agitation member.

Desirably, in the developing device, the communication section is formed on a side wall of the development section in the axis direction, the communication section being located at a portion of the side wall in a vertical direction.

To achieve the abovementioned object an image forming apparatus reflecting one aspect of the present invention includes: a developer bearing member configured to bear a developer; a plurality of development sections configured to house the developer to be borne on the developer bearing member, the development sections being arranged in an axis direction of the developer bearing member; a communication section disposed at a boundary of adjacent two development sections of the development sections, and configured to communicate between the two development sections; and a control section configured to perform an operation of moving the developer between the two development sections through the communication section to equalize degradation states of the developer in the two development sections.

Desirably, in the image forming apparatus, each of the development sections includes a rotatable agitation member configured to agitate the developer housed in the development section; and when moving the developer in one of the two development sections to the other of the two development sections, the control section sets a rotational frequency of the agitation member of the one of the two development sections to a value greater than a rotational frequency of the agitation member of the other of the two development sections.

Desirably, in the image forming apparatus, the control section controls the rotational frequency of the agitation member in accordance with a difference in coverage of a toner image corresponding to the two development sections.

Desirably, the image forming apparatus, further includes a degradation state detection section configured to detect degradation states of developer in the two development sections. The control section controls the rotational frequency of the agitation member in accordance with a difference in degradation state of the developer between the two development sections.

Desirably, in the image forming apparatus, a plurality of the degradation state detection sections are respectively provided in the development sections.

Desirably, in the image forming apparatus, the agitation member includes: a first agitation member configured to move the developer to a side opposite to the communication section in the axis direction, and a second agitation member configured to move the developer to the communication section side in the axis direction; and the communication section is located at a position corresponding to the second agitation member.

Desirably, in the image forming apparatus, the communication section is formed on a side wall of the development section in the axis direction, the communication section being located at a portion of the side wall in a vertical direction.

DESCRIPTION OF THE PREFERRED EMBODIMENTS

Figure 2:
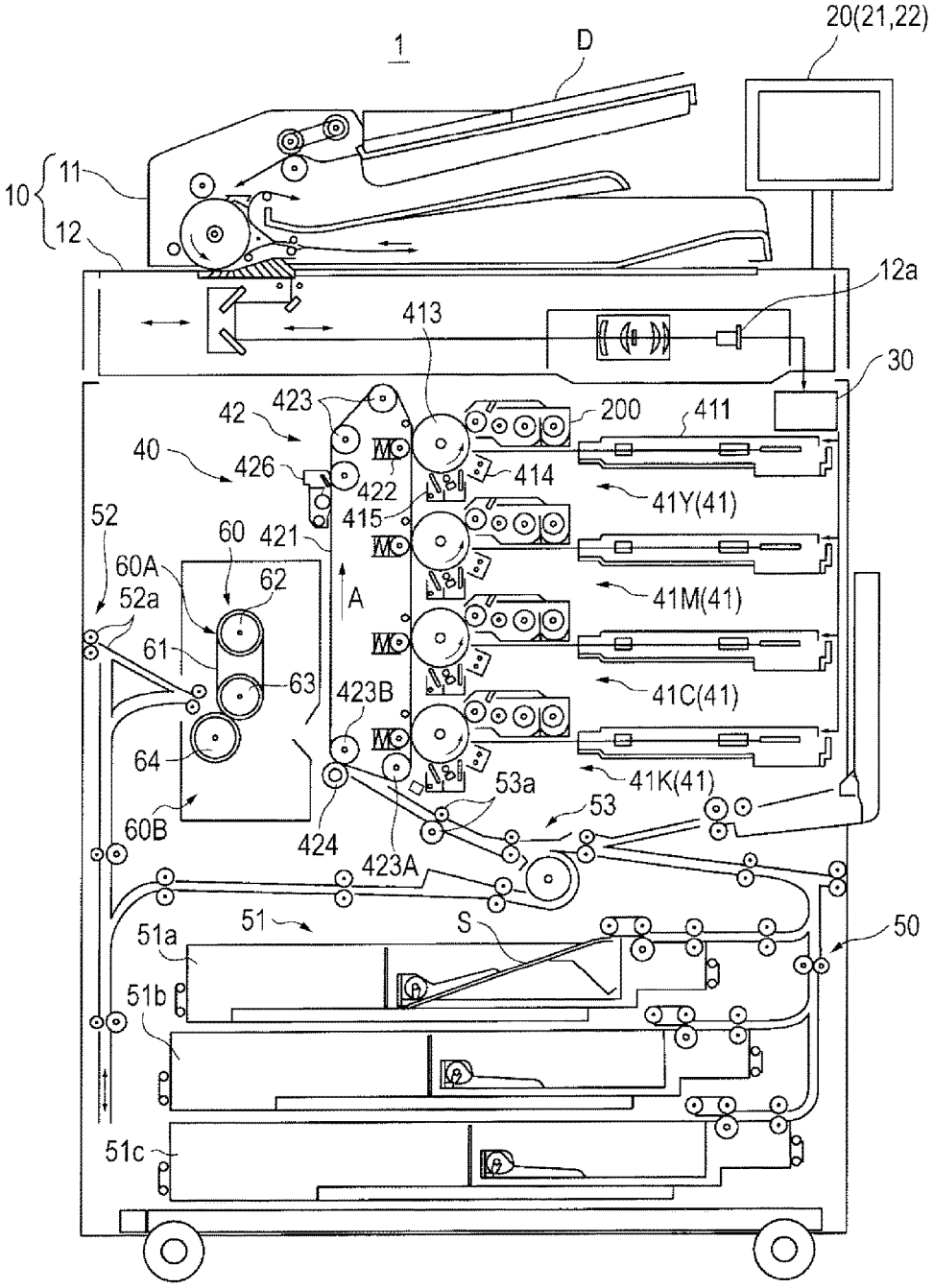
FIG. 2 schematically illustrates a general configuration of an image forming apparatus according to an embodiment.
Figure 3:
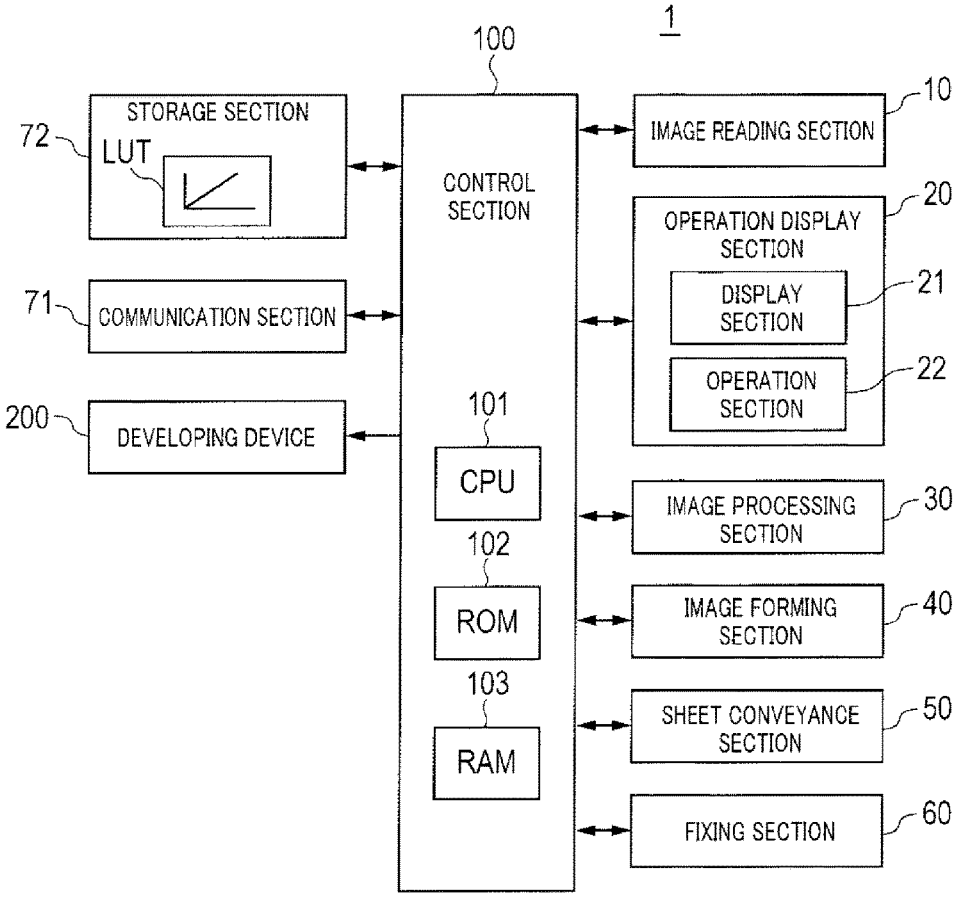
FIG. 3 illustrates a principal part of a control system of the image forming apparatus according to the embodiment.

In the following, the present embodiment is described in detail with reference to the drawings. FIG. 2 illustrates an overall configuration of image forming apparatus 1 according to the present embodiment. FIG. 3 illustrates a principal part of a control system of image forming apparatus 1 according to the embodiment.

Image forming apparatus 1 illustrated in FIGS. 2 and 3 is a color image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming system 1 secondary-transfers the resultant image to sheet S, thereby forming an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

Image forming apparatus 1 includes image reading section 10, operation display section 20, image processing section 30, image forming section 40, sheet conveyance section 50, fixing section 60 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data (input image data) transmitted from the external apparatus, and performs control to form an image on sheet S on the basis of the image data. Communication section 71 is composed of, for example, a communication control card such as a LAN card.

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) provided with a touch panel, and functions as display section 21 and operation section 22. Display section 21 displays various operation screens, image conditions, operating statuses of functions, information in image forming apparatus 1, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 2, reference signs are given to only the elements of image forming unit 41Y for the Y component, and reference signs are omitted for the elements of other image forming units 41M, 41C, and 41K.

Image forming unit 41 includes exposing device 411, developing device 200, photoconductor drum 413, charging device 414, drum cleaning device 415 and the like.

Photoconductor drum 413 is a negative-charging type organic photoconductor (OPC) having photoconductivity in which an undercoat layer (UCL), a charge generation layer (CGL), and charge transport layer (CTL) are sequentially stacked on a peripheral surface of a conductive cylindrical body made of aluminum (aluminum raw pipe), for example.

Charging device 414 causes corona discharge to evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. The positive charge is generated in the charge generation layer of photoconductor drum 413 and is transported to the surface of the charge transport layer, whereby the surface charge (negative charge) of photoconductor drum 413 is neutralized. An electrostatic latent image of each color component is formed on the surface of photoconductor drum 413 by the potential difference from its surroundings.

Developing device 200 is a developing device of a two-component reverse type, and attaches toners of respective color components to the surface of photoconductor drums 413, and visualizes the electrostatic latent image to form a toner image. Developing device 200 forms a toner image on the surface of photoconductor drum 413 by supplying the toner included in the developer to photoconductor drum 413.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. When driving roller rotates, intermediate transfer belt 421 travels in direction A at a constant speed. Intermediate transfer belt 421 is a conductive and elastic belt, and is driven into rotation with a control signal from control section 100.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

Belt cleaning device 426 removes transfer residual toner which remains on the surface of intermediate transfer belt 421 after a secondary transfer.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side, that is, a side of intermediate transfer belt 421 that makes contact with primary transfer rollers 422 whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to backup roller 423B, and an electric charge of the polarity identical to the polarity of the toner is applied to the front side, that is, a side of sheet S that makes contact with intermediate transfer belt 421 whereby the toner image is electrostatically transferred to sheet S.

Fixing section 60 includes upper fixing section 60A having a fixing side member disposed on a fixing surface side, that is, a side of the surface on which a toner image is formed, of sheet S, lower fixing section 60B having a rear side supporting member disposed on the rear surface side, that is, a side of the surface opposite to the fixing surface, of sheet S, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S.

Upper side fixing section 60A includes endless fixing belt 61, heating roller 62 and fixing roller 63, which serve as a fixing side member. Fixing belt 61 is installed in a stretched state between heating roller 62 and fixing roller 63.

Lower fixing section 60B includes pressure roller 64 that is the rear side supporting member. Together with fixing belt 61, pressure roller 64 forms a fixing nip for conveying sheet S in a sandwiching manner.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance.

Conveyance path section 53 includes a plurality of pairs of conveyance rollers such as a pair of registration rollers 53*a*, and the like. Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Figure 4:
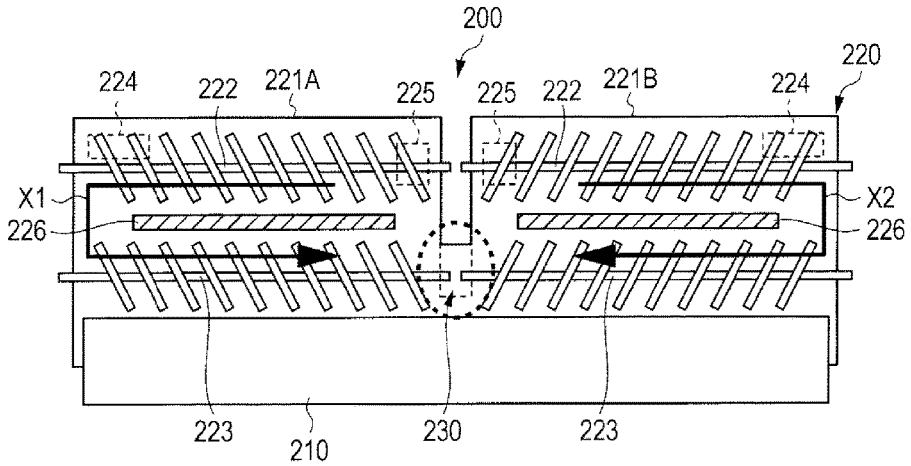
FIG. 4 illustrates a developing device as viewed from the upper side.
Figure 5:
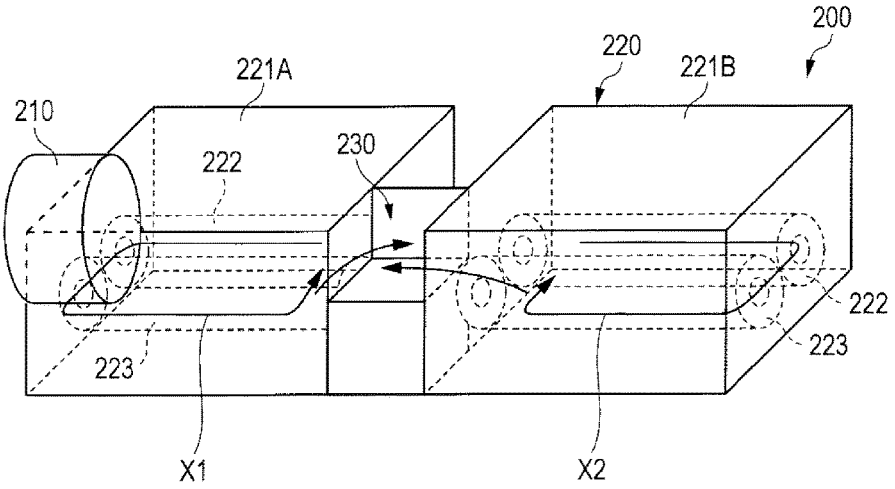
FIG. 5 is a perspective view schematically illustrating the developing device.

Next, developing device 200 is described in detail. FIG. 4 illustrates developing device 200 as viewed from the upper side. FIG. 5 is a perspective view schematically illustrating developing device 200.

As illustrated in FIG. 4 and FIG. 5, developing device 200 has a size that allows for processing of sheets which are long in the axis direction such as B1 sheet, and includes developing sleeve 210 and developer housing 220. Developing sleeve 210 is a developer bearing member that bears developer, and has an axial length corresponding to long sheets.

Developer housing 220 includes first development section 221A and second development section 221B for housing developer. First development section 221A and second development section 221B correspond to "a plurality of development sections" of the embodiment the present invention.

The developer in first development section 221A and second development section 221B is supplied to developing sleeve 210. First development section 221A and second development section 221B have the same configuration, and are disposed side by side in the axis direction such that first development section 221A and second development section 221B are symmetric with respect to the center in the axis direction.

In addition, communication section 230 is provided between first development section 221A and second development section 221 adjacent to each other, and first development section 221A and second development section 221B are communicated with each other through communication section 230.

Each of first development section 221A and second development section 221B includes first agitation member 222, second agitation member 223, toner density detection section 224, and toner replenishment section 225.

First agitation member 222 is provided at a position remote from developing sleeve 210 relative to second agitation member 223 in first development section 221A and second development section 221B. First agitation member 222 moves the developer from a portion corresponding to a center portion toward a portion corresponding to an end portion of developing sleeve 210 in the axis direction in first development section 221A and second development section 221B. In other words, first agitation member 222 moves the developer toward the side opposite to communication section 230 in the axis direction.

Second agitation member 223 is provided at a portion opposite to developing sleeve 210 in first development section 221A and second development section 221B. Second agitation member 223 moves the developer from a portion corresponding to an end portion toward a portion corresponding to a center portion of developing sleeve 210 in the axis direction in first development section 221A and second development section 221B. In other words, second agitation member 223 moves the developer toward communication section 230 in the axis direction.

In addition, in each of first development section 221A and second development section 221B, a first region of first agitation member 222 and a second region of second agitation member 223 are partitioned with partition section 226. When partitioned with partition section 226, the first region and the second region in first development section 221A and second development section 221B are communicated with each other at portions corresponding to the end portions of first agitation member 222 and second agitation member 223. With this configuration, when first agitation member 222 and second agitation member 223 are rotated, the developer is moved in directions of arrows X1 and X2 in first development section 221A and second development section 221B, and in turn, the developer in first development section 221A and second development section 221B is agitated.

Toner density detection section 224 detects the toner density in first development section 221A and second development section 221B. Toner replenishment section 225 supplies toner to each of first development section 221A and second development section 221B. Control section 100 controls the toner supply amount of toner replenishment section 225 based on the detection result of toner density detection section 224.

Figure 6A:
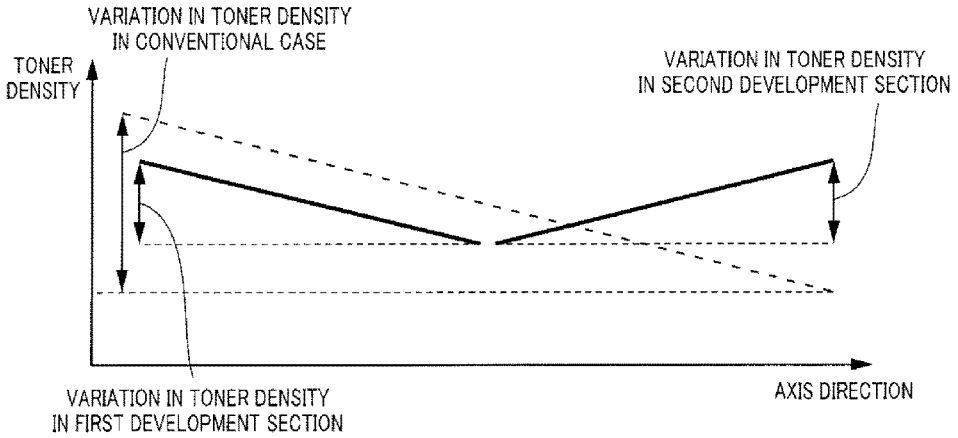
FIG. 6A illustrates a toner density in the axis direction in the developing device.

In the case where the toner in first development section 221A and second development section 221B is consumed and new toner is supplied thereto, the developer moves in first development section 221A and second development section 221B in the axis direction, and consequently the toner density varies in the axis direction. For example, when toner is supplied by toner replenishment section 225, the new toner is mixed from the upstream side in the moving direction of the developer at a position corresponding to second agitation member 223, and consequently the toner density decreases toward the downstream side of the moving direction as illustrated in FIG. 6A. In contrast, the charge amount of the toner increases toward the downstream side of the moving direction as illustrated in FIG. 6B since the smaller the toner density, the larger the amount of the toner which is mixed with the carrier and charged.

Figure 1A:
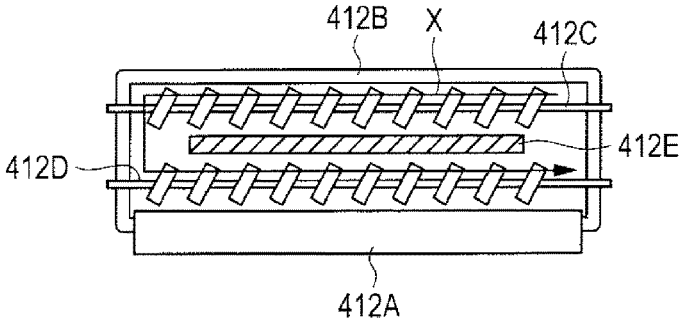
FIG. 1A is a sectional view schematically illustrating a conventional developing device.
Figure 1B:
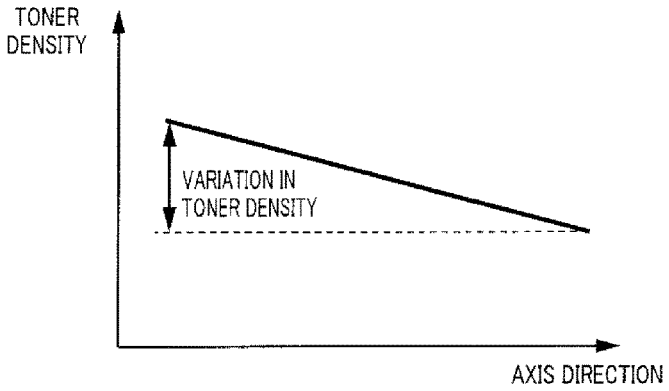
FIG. 1B illustrates a toner density in the axis direction in a conventional developing device.
Figure 1C:
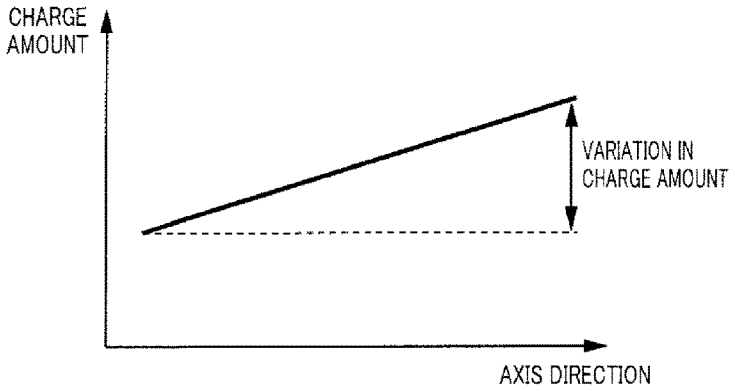
FIG. 1C illustrates a charge amount of toner in the axis direction in a conventional developing device.
Figure 6B:
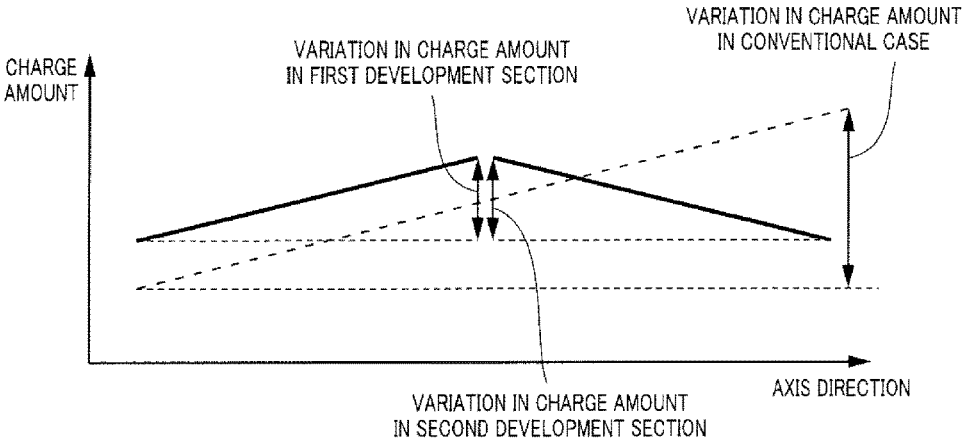
FIG. 6B illustrates a charge amount of toner in the axis direction in the developing device.

Incidentally, for example, in the case where a development section is configured to have a length corresponding to the length of developing sleeve 210 for the purpose of processing sheets which are long in the axis direction such as B1 sheet as in a conventional example illustrated in FIG. 1A, the variation of the toner density and the toner charge amount in the axis direction is undesirably increased in accordance with the increased length of the development section in the axis direction as illustrated in FIG. 6A and FIG. 6B. In contrast, in the present embodiment, first development section 221A and second development section 221B whose lengths are approximately equal to that of the conventional development section before the size change are disposed side by side in the axis direction, and thus it is possible to set the variation of the toner density and the toner charge amount in the axis direction to a value approximately equal to that of the conventional development section before the size change.

In addition, sheets which are long in the axis direction are in some situation cut by a post-processing machine after the image formation. In this case, for example, an image formation process can possibly be performed such that an image of a large coverage is formed in a half region in the axis direction and an image of a small coverage is formed in the other half region in the axis direction. An example case is described below in which an image of a small coverage (for example, 5%) is formed in a portion corresponding to first development section 221A and an image of a large coverage (for example, 100%) is formed in a portion corresponding to second development section 221B as illustrated in FIG. 7.

Figure 7:
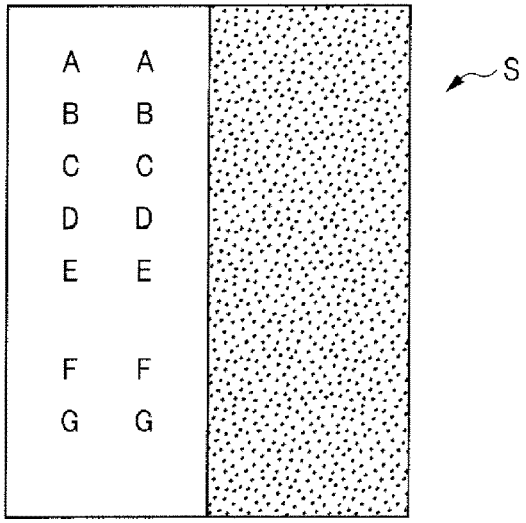
FIG. 7 illustrates a sheet having a toner image in which the difference in coverage is large between two sides in the axis direction.

In the case of FIG. 7, a large amount of toner is consumed in second development section 221B while the toner is not largely consumed in first development section 221A. While the toner corresponding to the consumption is supplied and toner exchanging is frequently performed in second development section 221B, toner exchanging is not frequent in first development section 221A in which the toner consumption is not significant.

As a result, the use history of the carrier is accumulated and the degradation of the carrier is facilitated in second development section 221B in comparison with first development section 221A, and consequently a difference in degradation state of the carrier is easily caused between first development section 221A and second development section 221B.

When the carrier is degraded, the charging performance of the toner is reduced, and toner scattering is disadvantageously caused. Moreover, when a difference in degradation state of the carrier, that is, degradation state of the developer, is caused between first development section 221A and second development section 221B, the unevenness in image density is disadvantageously caused in an image formed on sheet.

In view of this, in the present embodiment, control section 100 performs an operation of moving developer between first development section 221A and second development section 221B through communication section 230 to equalize the degradation state of the developer in first development section 221A and second development section 221B. With this configuration, it is possible to reduce image defects caused by a difference in degradation state of the developer between first development section 221A and second development section 221B. Operations of communication section 230 and control section 100 are described below.

As illustrated in FIG. 4 and FIG. 5, communication section 230 is located at a position corresponding to second agitation member 223 of first development section 221A and second development section 221B. With communication section 230 located at a position corresponding to second agitation member 223, the developer moved by second agitation member 223 toward the center portion in the axis direction of developing sleeve 210 can be controlled to flow into communication section 230 along its moving direction.

Communication section 230 is located at a position corresponding to the upper end portions of first development section 221A and second development section 221B. When communication section 230 is formed throughout first development section 221A and second development section 221B in the vertical direction, a large amount of the developer flows into communication section 230, and the movement (arrows X1 and X2 in FIG. 5) of the developer in first development section 221A and second development section 221B can possibly be blocked.

In the present embodiment, since communication section 230 is located at a position corresponding to the upper end portions of first development section 221A and second development section 221B, the developer coming through communication section 230 and the developer staying in the development section can be agitated at a position below communication section 230 in each of first development section 221A and second development section 221B. Therefore, it is possible to suppress blocking of the movement of the developer in each of first development section 221A and second development section 221B while preventing inflow of a large amount of developer to communication section 230.

Communication section 230 is located at a position where developer can be supplied to developing sleeve 210. When the developer located in communication section 230 cannot be supplied to developing sleeve 210, the image cannot be formed at a portion corresponding to communication section 230 of developing sleeve 210. In contrast, in the present embodiment, the developer can be supplied to developing sleeve 210 at a portion corresponding to communication section 230, and thus an image can be formed at a portion corresponding to communication section 230 of developing sleeve 210.

In addition, in the present embodiment, each of first development section 221A and second development section 221B is provided with first agitation member 222 and second agitation member 223, and first agitation member 222 and second agitation member 223 independently rotate under the control of control section 100 in each of first development section 221A and second development section 221B.

When moving the developer of one of first development section 221A and second development section 221B to the other development section, control section 100 operates to set the rotational frequency of first agitation member 222 and second agitation member 223 of the one of first development section 221A and second development section 221B to a value greater than the rotational frequency of first agitation member 222 and second agitation member 223 of the other development section.

To be more specific, control section 100 controls the rotational frequency of first agitation member 222 and second agitation member 223 based on the difference in coverage of the toner image corresponding to first development section 221A and second development section 221B.

The difference in coverage of the toner image is calculated from the coverage of the toner image corresponding to first development section 221A and second development section 221B which is set in the image formation condition. When the difference in coverage of the toner image is equal to or greater than 10%, control section 100 increases the rotational frequency of first agitation member 222 and second agitation member 223 in the development section of the smaller coverage of the toner image for each of a predetermined number of sheets (for example, 1,000 sheets).

In this manner, it is possible to move the developer from the development section of the smaller coverage of the toner image, that is, the development section in which toner exchanging is not frequent, to the development section in which the toner exchanging is frequent and the degradation of the carrier is significant. As a result, it is possible to suppress the increase of the difference in degradation state of the developer between first development section 221A and second development section 221B.

Figure 8:
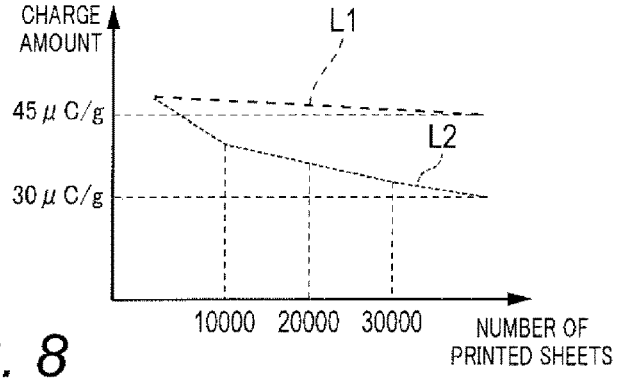
FIG. 8 illustrates a charge amount of toner with respect to the number of prints in the case where no developer moves through a communication section.

To be more specific, in the case where sheet S illustrated in FIG. 7 is printed, the carrier is degraded and the charging performance of the toner is reduced in second development section 221B since the toner consumption amount is large in the portion corresponding to second development section 221B. As illustrated in FIG. 8, in the case where the developer is not moved through communication section 230, the reduction in charge amount of the toner in second development section 221B (see broken line L2) becomes significant than the reduction in charge amount of the toner in first development section 221A (see broken line L1) as the number of prints increases. In this case, after the number of prints exceeds 30,000 sheets, the charge amount of the toner in first development section 221A is 45 μC/g while the charge amount of the toner in second development section 221B is 30 μC/g, that is, the difference in charge amount of the toner is 15 μC/g.

Figure 9:
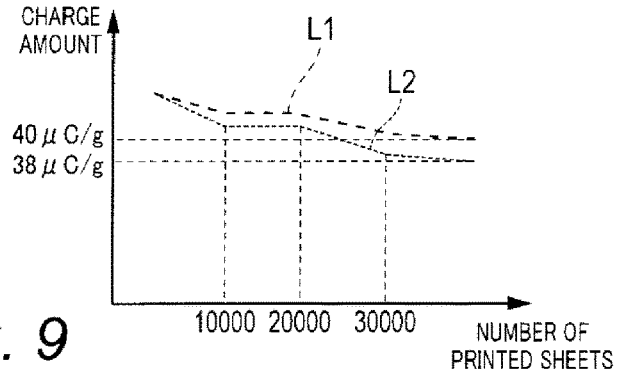
FIG. 9 illustrates a charge amount of toner with respect to the number of prints in the case where the developer moves through a communication section.

In contrast, as illustrated in FIG. 9, when the developer moves through communication section 230, the developer is appropriately mixed between first development section 221A and second development section 221B through communication section 230, and consequently the difference in charge amount of the toner is relatively small even when the number of prints is large. In this case, even after the number of prints exceeds 30,000 sheets, the charge amount of the toner in first development section 221A (see broken line L1) is 40 μC/g while the charge amount of the toner in second development section 221B (see broken line L2) is 38 μC/g, that is, the difference in charge amount of the toner is suppressed to about 2 μC/g. That is, in the present embodiment, it is possible to suppress the increase of the difference in degradation state of the developer between first development section 221A and second development section 221B.

Figure 10:
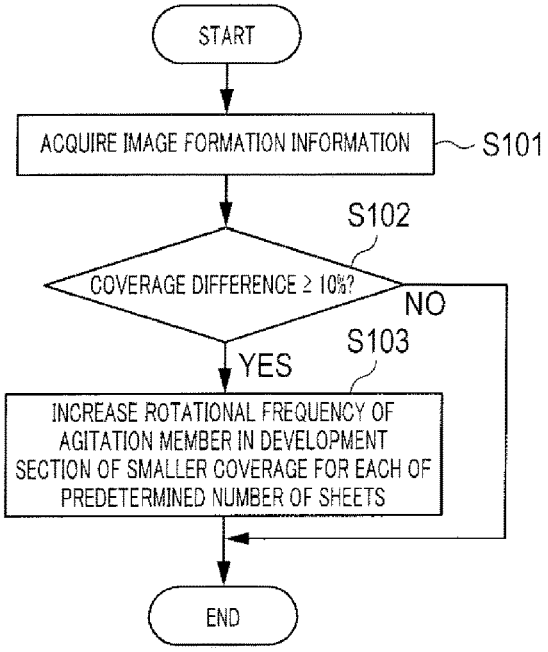
FIG. 10 is a flowchart of an exemplary operation of the image forming apparatus.

Next, an exemplary operation of image forming apparatus 1 is described. FIG. 10 is a flowchart of an exemplary operation of image forming apparatus 1. The processes in FIG. 10 are appropriately executed during a printing job.

As illustrated in FIG. 10, control section 100 acquires image formation information of the printing job (step S101). To be more specific, control section 100 calculates a difference in coverage of the toner image corresponding to first development section 221A and second development section 221B from the image formation information of the printing job.

Next, control section 100 determines whether the coverage difference is 10% or greater (step S102). When it is determined that the coverage difference is smaller than 10% (step S102, NO), printing is performed by the number of prints of the printing job, and then the operation is terminated.

When the coverage difference is equal to or greater than 10% (step S102, YES), control section 100 operates to increase the rotational frequency of the agitation member (first agitation member 222 and second agitation member 223) in the development section of the smaller coverage of the toner image for each of a predetermined number of sheets (step S103). After step S103, the operation is terminated.

According to the present embodiment having the above-mentioned configuration, the difference in degradation state of the developer which is caused between first development section 221A and second development section 221B can be suppressed, and accordingly the developer of the entirety of developing device 200 can be maintained at a stable state. Therefore, it is possible to reduce image defects caused by the difference in degradation state of the developer between first development section 221A and second development section 221B.

In addition, by causing a difference in rotational frequency of first agitation member 222 and second agitation member 223 between first development section 221A and second development section 221B, the developer is moved to the adjacent development section through communication section 230. Thus, the developer can be moved to the adjacent development section by a relatively simple control.

In addition, since communication section 230 is located at a position corresponding to second agitation member 223, it is possible to increase the ease of the control of the developer to flow into communication section 230 along the moving direction of the developer by the agitation operation of second agitation member 223.

In addition, since communication section 230 is located at a position corresponding to the upper end portions of the side walls of first development section 221A and second development section 221B, it is possible to suppress blocking of the movement of the developer in each of first development section 221A and second development section 221B while preventing inflow of a large amount of developer to communication section 230.

In addition, since communication section 230 is located at a position where the developer can be supplied to developing sleeve 210, it is possible to supply the developer to a position of developing sleeve 210 corresponding to communication section 230.

Next, a modification is described.

While the rotational frequency of first agitation member 222 and second agitation member 223 is controlled in accordance with the difference in coverage of the toner image in the above-mentioned embodiment, the present invention is not limited to this. For example, the rotational frequency of first agitation member 222 and second agitation member 223 may be controlled based on the difference in degradation state of the developer between first development section 221A and second development section 221B.

To be more specific, control section 100 controls the rotational frequency of first agitation member 222 and second agitation member 223 in accordance with a difference in degradation state of the developer between first development section 221A and second development section 221 based on a detection result of toner density detection section 224. Toner density detection section 224 corresponds to the "degradation state detection section" of the embodiment of the present invention.

The difference in degradation state of the developer is, for example, a difference in charge amount of the toner. The charge amount of toner is calculated by converting a toner density detected by toner density detection section 224. It is to be noted that the difference in degradation state of the developer may be a difference in density of the toner.

When the difference in charge amount of the toner is equal to or greater than 5 μC/g for example, control section 100 increases the rotational frequency of first agitation member 222 and second agitation member 223 in the development section of the larger charge amount of the toner for each of a predetermined number of sheets (for example, 1,000 sheets). In this manner, it is possible to move the developer from the development section having a larger charge amount of toner, that is, the development section in which the degradation of the carrier is less significant to the development section in which the degradation of the carrier is more significant. As a result, it is possible to suppress the increase of the difference in degradation state of the developer between first development section 221A and second development section 221B.

Figure 11:
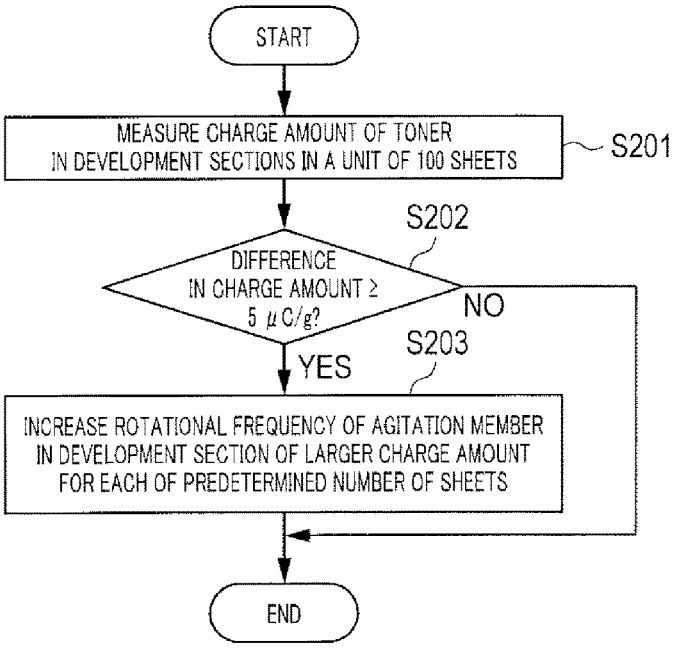
FIG. 11 is a flowchart of an exemplary operation of an image forming apparatus according to a modification.

Next, an exemplary operation of image forming apparatus 1 according to a modification is described. FIG. 11 is a flowchart of an exemplary operation of image forming apparatus 1 according to the modification. The processes in FIG. 11 are appropriately executed during a printing job.

As illustrated in FIG. 11, control section 100 measures the charge amount of the toner in first development section 221A and second development section 221B in a unit of 100 sheets (step S201). To be more specific, control section 100 calculates the charge amount of the toner based on the toner density in first development section 221A and second development section 221B detected by toner density detection sections 224 of first development section 221A and second development section 221B.

Next, control section 100 determines whether the difference in charge amount of the toner is 5 μC/g or greater (step S202). When it is determined that the difference in charge amount of the toner is smaller than 5 μC/g (step S202, NO), printing is performed by the number of prints in the printing job, and then the operation is terminated. It is to be noted that, also in the printing job after step S202, the processes of step S201 and step S202 may be performed as necessary.

When the difference in charge amount of the toner is equal to or greater than 5 μC/g (step S202, YES), control section 100 increases the rotational frequency of the agitation member (first agitation member 222 and second agitation member 223) in the development section having a larger toner charge amount of the toner image (step S203) for each of a predetermined number of sheets. After step S203, the operation is terminated.

While toner density detection section 224 is provided in each of first development section 221A and second development section 221B in the above-mentioned modification, the present invention is not limited to this. For example, it is possible to provide a toner density detection section that can detect a toner density based on a toner image adhered on intermediate transfer belt 421. In this case, the toner density detection section may be provided at a position corresponding to first development section 221A and second development section 221B in intermediate transfer belt 421.

While two development sections, first development section 221A and second development section 221B, are disposed side by side in the axis direction in the present embodiment, the present invention is not limited to this, and for example, three development sections may be disposed side by side in the axis direction.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

The present invention is applicable to an image forming system composed of a plurality of units including an image forming apparatus. The units include, for example, a post-processing apparatus, an external apparatus such as a control apparatus connected with a network, and the like.

What is claimed is:

1. A developing device comprising:

a developer bearing member configured to bear a developer, the developer bearing member having an axial length extending in an axis direction;

a plurality of development sections configured to house the developer to be borne on the developer bearing member, each development section having opposite sides defining a length of the development section in the axis direction, the development sections arranged side by side in the axis direction;

a communication section disposed at a boundary of adjacent two development sections of the development sections, and configured to communicate between the two development sections; and a control section configured to perform an operation of moving the developer between the two development sections through the communication section to equalize degradation states of the developer in the two development sections.

2. The developing device according to claim 1, wherein:

each of the development sections includes a rotatable agitation member configured to agitate the developer housed in the development section; and when moving the developer in one of the two development sections to the other of the two development sections, the control section sets a rotational frequency of the agitation member of the one of the two development sections to a value greater than a rotational frequency of the agitation member of the other of the two development sections.

3. The developing device according to claim 2, wherein the control section acquires image formation information, calculates from the acquired image formation information a difference in coverage of a toner image corresponding to the two development sections, and controls the rotational frequency of the agitation member in accordance with the difference.

4. The developing device according to claim 2 further comprising a degradation state detection section configured to detect degradation states of developer in the two development sections, wherein the control section controls the rotational frequency of the agitation member in accordance with a difference in degradation state of the developer between the two development sections.

5. The developing device according to claim 4, wherein a plurality of the degradation state detection sections are provided in the respective development sections.

6. The developing device according to claim 2, wherein:

the agitation member includes:

a first agitation member configured to move the developer to a side opposite to the communication section in the axis direction, and a second agitation member configured to move the developer to the communication section side in the axis direction; and the communication section is located at a position corresponding to the second agitation member.

7. The developing device according to claim 1, wherein the communication section is formed on a side wall of one of the two adjacent development sections in the axis direction, the communication section being located at a portion of the side wall in a vertical direction.

8. An image forming apparatus comprising:

a developer bearing member configured to bear a developer, the developer bearing member having an axial length extending in an axis direction;

a plurality of development sections configured to house the developer to be borne on the developer bearing member, each development section having opposite sides defining a length of the development section in the axis direction, the development sections arranged side by side in the axis direction;

a communication section disposed at a boundary of adjacent two development sections of the development sections, and configured to communicate between the two development sections;

a control section configured to perform an operation of moving the developer between the two development sections through the communication section to equalize degradation states of the developer in the two development sections, and an image forming section configured to transfer developer borne on the developer bearing member to a sheet.

9. The image forming apparatus according to claim 8, wherein each of the development sections includes a rotatable agitation member configured to agitate the developer housed in the development section; and when moving the developer in one of the two development sections to the other of the two development sections, the control section sets a rotational frequency of the agitation member of the one of the two development sections to a value greater than a rotational frequency of the agitation member of the other of the two development sections.

10. The image forming apparatus according to claim 9, wherein the control section acquires image formation information, calculates from the acquired image formation information a difference in coverage of a toner image corresponding to the two development sections, and controls the rotational frequency of the agitation member in accordance with the difference.

11. The image forming apparatus according to claim 9 further comprising a degradation state detection section configured to detect degradation states of developer in the two development sections, wherein the control section controls the rotational frequency of the agitation member in accordance with a difference in degradation state of the developer between the two development sections.

12. The image forming apparatus according to claim 11, wherein a plurality of the degradation state detection sections are respectively provided in the development sections.

13. The image forming apparatus according to claim 9, wherein:

the agitation member includes:

a first agitation member configured to move the developer to a side opposite to the communication section in the axis direction, and a second agitation member configured to move the developer to the communication section side in the axis direction; and the communication section is located at a position corresponding to the second agitation member.

14. The image forming apparatus according to claim 8, wherein the communication section is formed on a side wall of one of the two adjacent development sections in the axis direction, the communication section being located at a portion of the side wall in a vertical direction.

15. The developing device according to claim 1, wherein the developer bearing member has a first end and a second end opposite the first end in the axis direction, a first of the two development sections is closer to the first end than a second of the two development sections, and the second of the two development sections is closer to the second end than the first of the two development sections.

16. The image forming apparatus of claim 8, wherein the developer bearing member has a first end and a second end opposite the first end in the axis direction, a first of the two development sections is closer to the first end than a second of the two development sections, and the second of the two development sections is closer to the second end than the first of the two development sections.

* * * * *